United States Patent [19]

Liman

[11] 4,081,864

[45] Apr. 4, 1978

[54] SKI GLOVE OR MITT

[75] Inventor: Sandy Liman, Ketchum, Id.

[73] Assignee: Scott USA, Inc., Sun Valley, Id.

[21] Appl. No.: 723,024

[22] Filed: Sep. 13, 1976

[51] Int. Cl.[2] ..... A63D 5/00; A41D 19/00

[52] U.S. Cl. ..... 2/161 A; 273/54 B

[58] Field of Search ..... 273/54 B, 72 R; 2/16, 2/20, 159, 161 R, 161 A, 169; 280/11.37 H, 11.37 D, 11.37 L

[56] References Cited

U.S. PATENT DOCUMENTS

| | | | |
|---|---|---|---|
| 3,218,089 | 11/1965 | March et al. | 280/11.37 |
| 3,863,271 | 2/1975 | Moroney | 2/161 A |
| 3,874,686 | 4/1975 | Borden et al. | 280/11.37 H |

*Primary Examiner*—Doris L. Troutman

*Attorney, Agent, or Firm*—Wegner, Stellman, McCord, Wiles & Wood

[57] ABSTRACT

A ski glove or mitt capable of interlocking engagement with an extension on a strapless ski pole grip has a protective covering with a thumb stall and a finger stall for containing one or more fingers of the skier's hand. An interlock layer, stitched to the back of the protective covering, has a raised padding which surrounds a recess having a shape conforming to the shape of the grip extension for snugly seating the grip extension. A palmar layer of anti-slip fabric impregnated with a vinyl is stitched to the palm of the protective covering and has a stippled texture which mates with stipples on the grip body. Shock absorption is provided by a padded heel stitched to the heel of the protective covering where the bottom of the skier's hand engages a platform on the ski pole grip.

12 Claims, 5 Drawing Figures

SKI GLOVE OR MITT

BACKGROUND OF THE INVENTION

This invention relates to a ski glove or mitt which is capable of interlocking with an extension on a ski pole grip.

Strapless ski pole grips are known in which one or more finger extensions overlie a portion of a skier's hand to retain the grip even when the skier relaxes his grasp. Such grips are safer than grips having a strap which surrounds the skier's hand and can entrap the hand should the ski pole become caught on an object. When the finger extensions are sufficiently long and formfitting to encompass a substantial portion of the skier's hand, the skier can relax his grip to a substantial extent without losing the grip or losing its orientation within the skier's hand. However, too loose a grasp will allow a strapless ski pole grip to rotate out of the position necessary for proper pole planting. Also, adverse atmospheric conditions such as snow and sleet can cause the ski pole grip to slide and rotate slightly out of position within the skier's hand.

Prior ski pole gloves and mitts have incorporated snap connectors which mate with snap connectors on a ski pole grip. Such an interlocked glove and grip unduly hinders the ability of a skier to withdraw his gloved hand from the grip while waiting in lift lines and the like. It also has been proposed to interlock and produce a non-slip engagement between a glove and handle by using detachable fabric fasteners on the glove and handle. While fabric fasteners may work when holding only one handle, ski poles are held in both gloved hands and such fasteners do not allow easy withdrawal of the skier's hand, except by use of the other gloved hand which also is interlocked to a ski pole.

SUMMARY OF THE INVENTION

In accordance with the present invention, an improved ski glove or mitt is provided which overcomes the disadvantages noted above with prior ski gloves and mitts. An interlock layer has raised padding which surrounds a recess shaped to snugly seat one or more extensions of the ski pole grip. The recessed seat allows the skier to loosen his grasp while still retaining precise control over the ski pole. An antislip layer is secured to the palm and has a textured surface which mates with a stippled surface on the body of the ski grip. The heel of the glove has a padded lining which reduces shock during pole plants.

One object of the present invention is the provision of an improved ski glove or mitt having an interlock layer containing a recess which snugly seats an extension on a ski pole grip.

Other objects and features of the invention will be apparent from the following description and from the drawings. While an illustrative embodiment of the invention is shown in the drawings and will be described in detail herein, the invention is susceptible of embodiment in many different forms and it should be understood that the present disclosure is to be considered as an exemplification of the principles of the invention and is not intended to limit the invention to the embodiment illustrated.

DESCRIPTION OF THE PREFERRED EMBODIMENT

Figure 1:
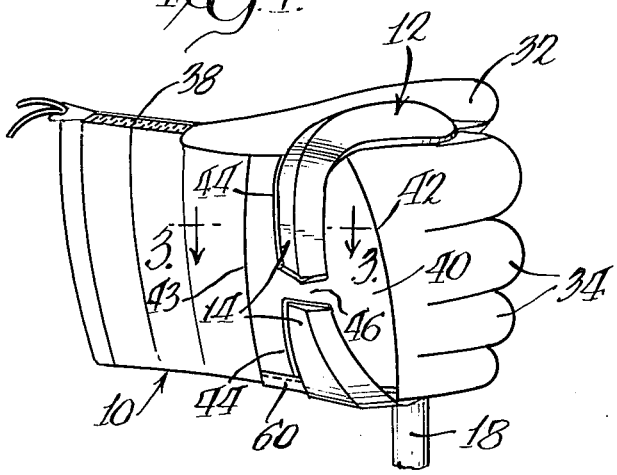
FIG. 1 is a perspective view of an improved ski glove shown in interlocking engagement with a pair of extensions of a strapless ski pole grip.
Figure 2:
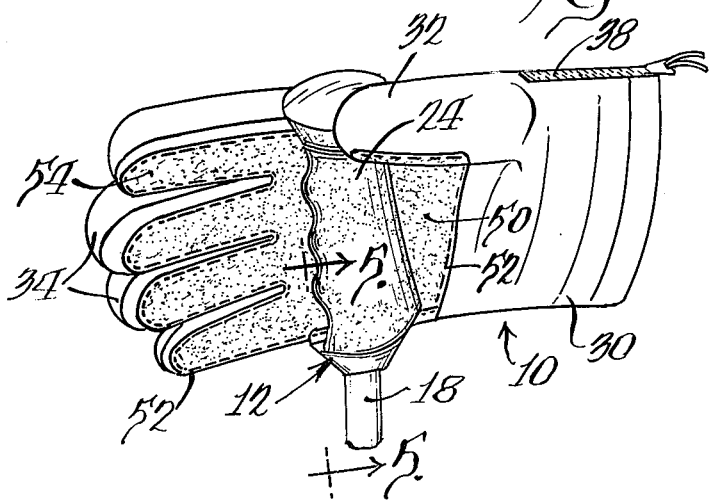
FIG. 2 is a perspective view of the opposite side of the glove and grip of FIG. 1, with the glove fingers and thumb being extended to an open position.
Figure 4:
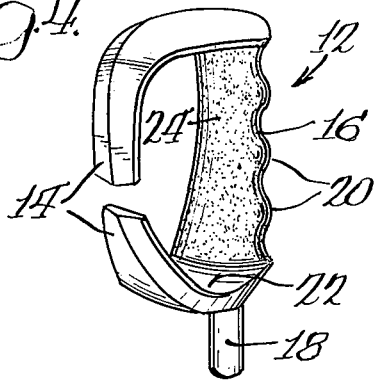
FIG. 4 is a perspective view of the strapless ski pole grip shown in FIGS. 1 and 2.

Turning to FIGS. 1 and 2, an improved ski glove 10 which can also take the form of a ski mitt is shown in interlocking engagement with a ski pole grip 12 which has one or more finger extensions 14 extending therefrom across the back of the skier's gloved hand. The improved glove 10 can be utilized with any ski pole grip 12 which has one or more extensions 14 which overlie at least a portion of the skier's hand for the purpose of improving retention of the grip by the skier's hand. Grip 12, as also seen in FIG. 4, illustratively comprises an elongated grip body 16 with an axial bore for receiving the shaft 18 of a ski pole. Integral with the elongated body 16 and extending from the ends thereof are the pair of extensions 14, in the form of resilient projecting fingers which are self-supporting and will resiliently deflect sideways to allow sliding withdrawal of the skier's gloved hand. The grip body 16 has a generally vertical, forward facing surface or area defined by a series of ridges 20 and associated valleys therebetween for receiving the four fingers of the skier's gloved hand. The lower lateral section or base 22 of the lower extension 14 is sufficiently thick to form an essentially rigid platform for supporting the base or heel of the skier's hand. The grip 12, to the extent described above, is disclosed in a patent application of James E. Tobin, Ser. No. 539,025, entitled "Ski Pole Grip", filed Jan. 10, 1975, and assigned to the same assignee as the present invention now U.S. Pat. No. 3,992,021 issued Nov. 16, 1976.

The surface of the elongated body 16 may be molded with a large number of small dimples or stipples 24 to improve the anti-slip characteristics of the grip.

Figure 3:
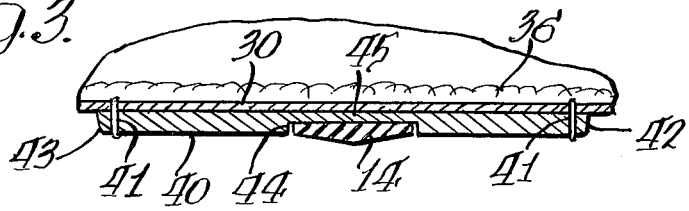
FIG. 3 is a sectional view of the glove and one grip extension, taken along lines 3—3 of FIG. 1.
Figure 5:
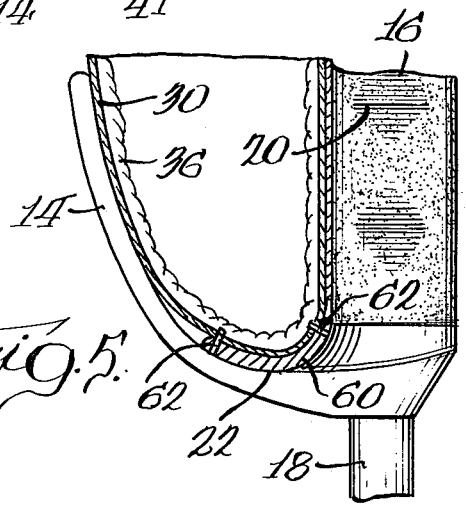
FIG. 5 is a front view, partly in section, of the heel portion of the glove and the lower portion of the grip, taken along lines 5—5 of FIG. 2.

Ski glove 10 comprises a protective covering 30 of leather or a synthetic material having a thumb compartment or stall 32 and a finger compartment or stall 34 for containing one or more fingers of the skier's hand. The present invention can be used either with a glove, having separate finger stalls 34 for each of the fingers, or for a ski mitt, having a single finger stall for containing all of the skier's fingers. A fleece lining 36, FIGS. 3 and 5, is attached to the inside of the protective covering 30 to provide warmth and moisture absorption for the glove. A zipper 38 allows a portion of the protective covering 30 to be opened for easier access by the hand when entering the glove. To the extent described above in this paragraph, the ski glove is conventional and the exact method of manufacture may take a variety of conventional forms.

In accordance with the present invention, an interlock padding layer 40 is secured to the back of the protective covering 30 by stitching 41, see FIG. 3. The interlock layer 40 extends from the knuckle region 42, that is, the transition between the finger stalls 34 and the back of the hand, rearward and terminates at a rear edge 43 located before the wrist region. The layer is formed of a leather or synthetic padding which surrounds and defines a recess 44 of reduced thickness 45, shaped to snugly seat at least a portion of the extensions 14. Desirably, the configuration of the seat recess 44 is U-shaped in length and encircles the entire extension 14 when the gloved hand is grasping the grip. The recess 44, which is a depressed channel which does not extend in depth through to the covering 30 and thus prevents the extension 14 when seated from contacting the protective covering 30, is only slightly larger in width than the extension 14 so as to snugly seat the extension between the raised padding. When a pair of extensions 14 are present on the grip 12, as illustrated, interlock layer 40 has a center ridge 46 which separates a pair of recesses 44 formed in the interlock layer 40. The ridge 46 prevents a rolling motion about the skier's hand.

The positive interlocking system which results when the male grip extensions 14 are captured by and properly indexed by the corresponding female seat 44 causes the ski pole 18 to remain indexed properly on the glove even without the gripping aid of the skier's hand. Furthermore, the raised padding 40 requires the extensions 14 to flex outwardly by a greater extent before releasing of the grip from the gloved hand, thereby increasing the retention characteristics while still allowing proper release in emergency conditions.

An anti-slip layer 50 is secured by stitching 52 to a palmar region opposite and spaced from the back, and to the back finger region of the protective covering 30. The anti-slip layer 50 has a stippled texture which mates with the grip stipples 24 to improve the non-slip characteristics of the glove. Anti-slip layer 50 may be composed of a knit fabric impregnated with a vinyl to provide good grip in wet and dry conditions and resistance to wear. Alternatively, layer 50 may be a knitted jersey fabric which is napped to give it a fleecy feel and which is vinyl impregnated. Both materials have good low temperature flexibility as is necessary for ski gloves which are worn in extremely cold temperatures.

To reduce shock during pole plants, a heel layer 60 is secured by stitching 62, see FIG. 5, to the bottom or heel of the protective covering 30 which joins the palmar region to the back region opposite the thumb stall. The heel layer 60 is comprised of a leather or synthetic padding which abuts the platform 22 of the ski pole grip when the gloved hand is grasping the grip. The heel layer 60 terminates on the inside adjacent the anti-slip layer 50.

While the stitchings 41, 52 and 62 have been illustrated as located along the periphery of the added layers, it should be understood that the stitching may also extend along the interior of the layers to improve retention. The stitching may be in contrasting colors or in the shape of various patterns.

The improved glove or mitt 10 can be worn when using any ski pole grip, as the added layers 40, 50 and 60 do not interfere in any way with use of the glove in combination with conventional ski pole grips having straps, or other configurations. The recesses 44 can be used to provide contrasting color combinations with the raised padding 40 or the covering 30 and can provide various graphic patterns of pleasing and aesthetic design.

Various modifications can be made to the improved glove or mitt, as desired. The various layers described herein can be used in different combinations, and are adapted for use with a wide variety of ski gloves and mitts.

I claim:

1. A ski glove or mitt capable of interlocking engagement with an extension of a ski pole grip which overlies a portion of a skier's hand, comprising:

a protective covering having a palmar region for engaging an elongated body of the ski pole grip, and other regions spaced from the palmar region including a thumb stall and a finger stall for containing one or more fingers of a skier's hand, and a raised padding secured to a portion of the other regions of the protective covering and containing a recess with a shape conforming at least in part to the shape of the extension on the ski pole grip, the recess snugly seating at least a portion of the extension to interlock the glove or mitt with the grip.

2. The ski glove or mitt of claim 1 for a ski pole grip having a second extension, wherein the raised padding contains a second recess shaped to seat at least portions of the second extension on the ski pole grip.

3. The ski glove or mitt of claim 1 wherein the other regions include a back region opposite the palmar region, and the raised padding covers a substantial portion of the back region of the protective covering.

4. A ski glove or mitt capable of interlocking engagement with a ski pole grip having an elongated body and an extension therefrom, comprising:

a protective covering including a thumb stall, a finger stall for containing one or more fingers of a skier's hand, and a palmar region with an anti-slip layer externally secured to at least a portion of the palmar region and having a textured surface for engagement with the elongated body of the ski pole grip, and a raised padding secured to a different region of the protective covering other than the palmar region and containing a recess with a shape conforming at least in part to the shape of the extension on the ski pole grip, the recess snugly seating at least a portion of the extension to interlock the glove or mitt with the grip.

5. The ski glove or mitt of claim 4 wherein the anti-slip layer comprises a fabric impregnated with a vinyl.

6. A ski glove or mitt capable of interlocking engagement with a ski pole grip having an elongated body and an extension therefrom, comprising:

a protective covering including a thumb stall, a finger stall for containing one or more fingers of a skier's hand, a palmar region for engaging the elongated body of the ski pole grip, a back region spaced from the palmar region, and a heel region joining the palmar and back regions opposite the thumb, a heel padding secured to the heel region of the protective covering for reducing shock to the skier's hand during a pole plant, and a raised padding secured to the back region of the protective covering and containing a recess with a shape conforming at least in part to the shape of the extension, the recess snugly seating at least a portion of the extension to interlock the glove or mitt with the grip.

7. The ski glove or mitt of claim 6 including an anti-slip layer secured to at least a portion of the palmar region and comprised of a fabric impregnated with vinyl.

8. The ski glove or mitt of claim 1 wherein the other regions include a transition region, between a back region and the finger stall, which is adjacent the knuckles of the skier's hand, and the raised padding extends on the back region from the transition region rearward but terminates at or before the wrist of the skier's hand.

9. The ski glove or mitt of claim 1 wherein the recess is of reduced thickness less than the thickness of the raised padding to prevent the extension when seated within the recess from contacting the protective covering.

10. A ski glove or mitt capable of interlocking engagement with a pair of resilient projecting fingers which extend from the ends of an elongated grip body of a ski pole grip and overlie at least a portion of a skier's hand, comprising:

a protective covering having a palmar portion for engaging the elongated grip body, a back portion spaced from the palmar portion, a thumb stall, and a finger stall for containing one or more fingers of the skier's hand, the back portion of the protective covering containing a first recess extending across a portion of the back portion and a second recess extending across a different portion of the back portion, the first and second recesses being separated to form separate seats for the pair of resilient projecting fingers of the ski pole grip to snugly interlock the glove or mitt with the grip.

11. A ski glove or mitt of claim 10 wherein each of the first and second recesses has a U-shape and extends across a substantial part of the back portion.

12. A ski glove or mitt of claim 10 wherein the first and second recesses are contained in an interlock layer which is stitched to the back portion of the protective covering, the recesses having a depth less than the depth of the interlock layer to prevent the pair of extensions when seated within the recessses from contacting the protective covering.

* * * * *